US007942299B2

(12) United States Patent
Steinbrunner et al.

(10) Patent No.: US 7,942,299 B2
(45) Date of Patent: May 17, 2011

(54) HAND TOOL WITH BELT OR RAFTER HOOK

(75) Inventors: Glen V. Steinbrunner, Bel Air, MD (US); Andrzej R. Wojcicki, Baltimore, MD (US); James R. Niblett, Columbia, MD (US)

(73) Assignee: Black & Decker Inc., Newark, DE (US)

( * ) Notice: Subject to any disclaimer, the term of this patent is extended or adjusted under 35 U.S.C. 154(b) by 853 days.

(21) Appl. No.: 11/444,284

(22) Filed: May 31, 2006

(65) Prior Publication Data

US 2007/0277990 A1 Dec. 6, 2007

(51) Int. Cl.
*A45F 5/00* (2006.01)
*B25F 5/00* (2006.01)

(52) U.S. Cl. ..... 227/156; 224/269; 224/271; 224/904

(58) Field of Classification Search ..... 224/163, 224/268, 269
See application file for complete search history.

(56) References Cited

U.S. PATENT DOCUMENTS

| | | | | |
|---|---|---|---|---|
| 3,906,615 | A * | 9/1975 | Campbell et al. | 29/432 |
| 5,180,091 | A * | 1/1993 | Ota | 227/8 |
| 5,265,312 | A * | 11/1993 | Okumura | 24/3.12 |
| 5,564,610 | A | 10/1996 | Barron | |
| 5,810,232 | A * | 9/1998 | Meurer et al. | 224/677 |
| 6,026,576 | A | 2/2000 | Hurn et al. | |
| 6,431,289 | B1 | 8/2002 | Potter et al. | |
| 6,484,750 | B1 * | 11/2002 | Foos et al. | 137/505.25 |
| 6,648,202 | B2 | 11/2003 | Miller et al. | |
| 6,679,406 | B2 * | 1/2004 | Sakai et al. | 224/269 |
| 6,732,627 | B2 | 5/2004 | Wattenbach et al. | |
| 6,761,264 | B2 * | 7/2004 | Steeber et al. | 198/844.1 |
| 6,938,812 | B2 | 9/2005 | Miller et al. | |
| 6,948,647 | B1 | 9/2005 | Niblett et al. | |
| 6,997,365 | B2 | 2/2006 | Miller et al. | |
| 7,111,364 | B2 * | 9/2006 | Bader et al. | 16/436 |
| 7,306,052 | B2 * | 12/2007 | Vahabi-Nejad et al. | 173/217 |
| 2002/0117531 | A1 * | 8/2002 | Schell et al. | 227/8 |
| 2002/0122707 | A1 | 9/2002 | Sakai | |
| 2002/0179659 | A1 | 12/2002 | Shaw | |
| 2003/0085243 | A1 | 5/2003 | Kahn | |

(Continued)

FOREIGN PATENT DOCUMENTS

DE 102 09 096 9/2002

(Continued)

OTHER PUBLICATIONS

U.S. Appl. No. 11/256,595, filed Oct. 21, 2005, Jenner et al.

*Primary Examiner* — Rinaldi I. Rada
*Assistant Examiner* — Lindsay Low
(74) *Attorney, Agent, or Firm* — Harness, Dickey & Pierce, P.L.C.

(57) ABSTRACT

A tool that includes a housing, a motor assembly, a hook structure and a detent. The motor assembly has an output member and is at least partially housed in the housing. The detent has a first portion, which is engaged to the housing, and a second portion that is engaged to the hook structure. The first and second portions cooperate in an engaged condition to hold the hook structure in a selected rotational position relative to the housing. The first and second portions being disengagable to permit rotational movement of the hook structure relative to the housing. The hook structure can include a friction enhancing portion that is employed to provide better gripping performance.

12 Claims, 6 Drawing Sheets

U.S. PATENT DOCUMENTS

| | | | | |
|---|---|---|---|---|
| 2003/0132264 | A1* | 7/2003 | Smolinski | 227/130 |
| 2003/0159843 | A1* | 8/2003 | Sakai et al. | 173/216 |
| 2004/0025226 | A1* | 2/2004 | Jaeger | 2/161.6 |
| 2004/0050888 | A1* | 3/2004 | Warner | 224/269 |
| 2004/0074938 | A1 | 4/2004 | Sakai et al. | |
| 2004/0156190 | A1* | 8/2004 | Tsuruta et al. | 362/119 |
| 2005/0015935 | A1 | 1/2005 | Bader et al. | |
| 2005/0061584 | A1* | 3/2005 | Louthen | 182/129 |
| 2005/0092792 | A1 | 5/2005 | Sakai | |
| 2005/0133393 | A1 | 6/2005 | Lawrence et al. | |
| 2005/0133552 | A1 | 6/2005 | Lawrence | |
| 2005/0157489 | A1 | 7/2005 | Oomori et al. | |
| 2005/0188550 | A1 | 9/2005 | Uehlein-Proctor et al. | |
| 2005/0218184 | A1 | 10/2005 | Buck | |
| 2006/0081667 | A1 | 4/2006 | Lai | |
| 2006/0091168 | A1 | 5/2006 | Ng | |
| 2006/0104735 | A1 | 5/2006 | Zeiler et al. | |

FOREIGN PATENT DOCUMENTS

| | | | |
|---|---|---|---|
| DE | 103 43 693 | | 12/2004 |
| DE | 10 2004 007 764 | | 9/2005 |
| EP | 1 197 299 | | 4/2002 |
| EP | 1 327 500 | | 7/2003 |
| EP | 1 371 456 | | 12/2003 |
| EP | 1 468 788 | | 10/2004 |
| EP | 1 477 648 | | 11/2004 |
| JP | 04283079 | A * | 10/1992 |
| JP | 2004181550 | A * | 7/2004 |
| WO | WO 2005/077608 | | 8/2005 |

* cited by examiner

HAND TOOL WITH BELT OR RAFTER HOOK

INTRODUCTION

The present invention generally relates to power tools and more particularly to a hook, such as a belt hook or a rafter hook, for a power tool.

Many power tools, such as drill/drivers and nailers, utilize a hook structure that permits the user to attach the power tool to a structure, such as a tool belt or a rafter, to hold the power tool in a desired location when it is not being used. Several hook configurations employ a hook structure that is non-movably fixed to another portion of the power tool. Other hook configurations may be releasably coupled to opposite sides of the power tool. Still other hook configurations utilize a hook structure that freely rotates about another portion of the power tool, such as the handle. It is one aspect of the present disclosure to provide a power tool having an improved hook configuration that may be releasably secured in a plurality of positions. It is another aspect of the present disclosure to provide a power tool having a hook configuration having better gripping performance.

SUMMARY

In one form, the present teachings provide a tool that includes a housing, a motor assembly, a hook structure and a detent. The motor assembly has an output member and is at least partially housed in the housing. The detent has a first portion, which is engaged to the housing, and a second portion that is engaged to the hook structure. The first and second portions cooperate in an engaged condition to hold the hook structure in a selected rotational position relative to the housing. The first and second portions being disengagable to permit rotational movement of the hook structure relative to the housing.

In another form, the present disclosure provides a tool having a housing, a motor assembly and a hook structure. The motor assembly includes an output member and is at least partially housed in the housing. The hook structure is coupled to the housing and includes a leg and an arm that spaces the leg apart from the housing. The hook structure has an interior surface that is bounded by the leg, the arm and the housing. The hook structure includes a friction enhancing portion that is coupled to the interior surface.

In still another form, the present disclosure provides a tool having a housing assembly, a motor assembly, a hook and a biasing spring. The housing assembly defines a body portion and a handle that is coupled to the body portion. The motor assembly includes an output member and is at least partially housed in the body portion. The hook is rotatably coupled to the handle. The biasing spring biases the hook into engagement with a structure to resist relative rotation between the handle and the hook.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
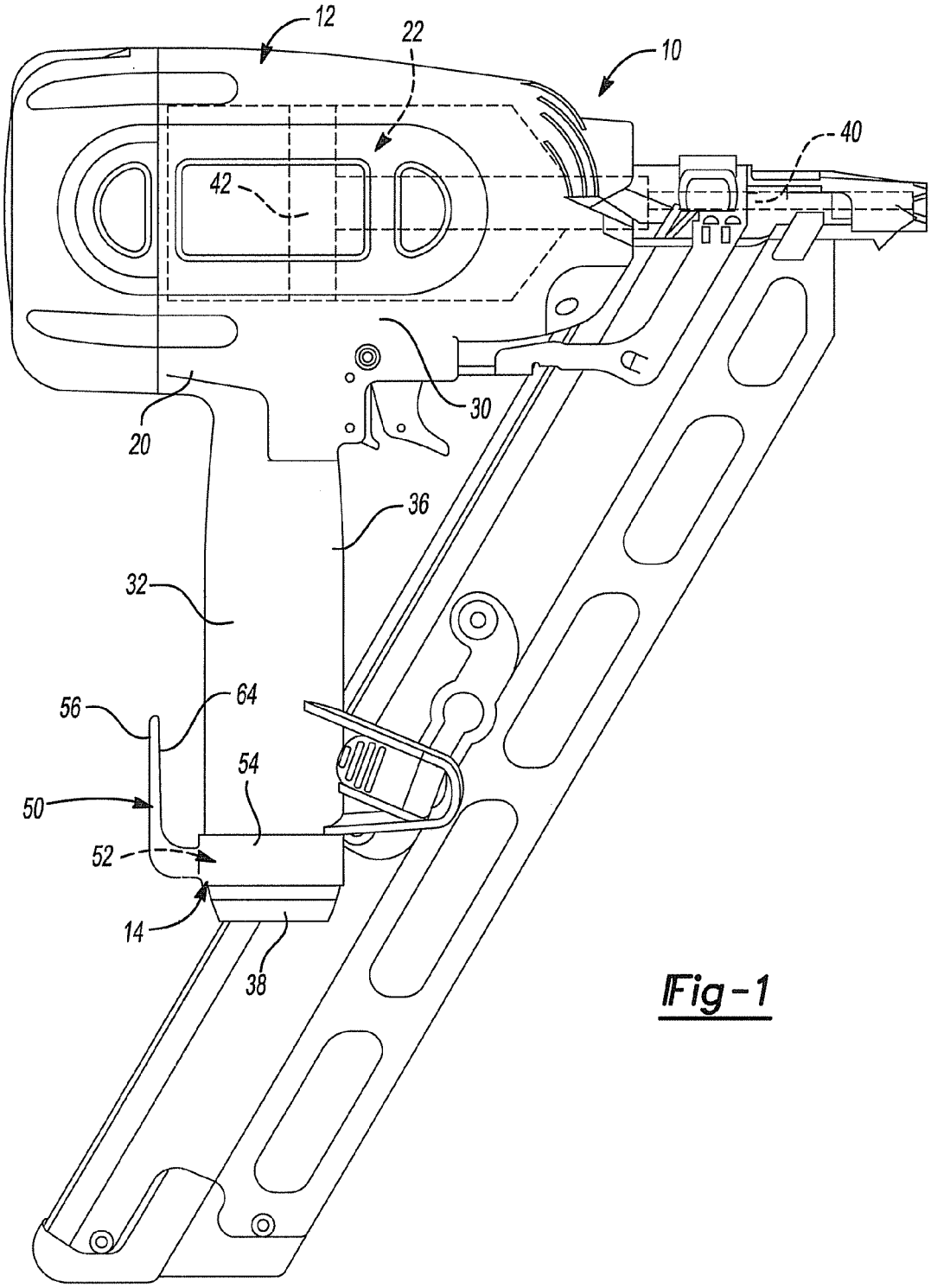
FIG. 1 is a side elevation view of the right side of a tool having a hook assembly constructed in accordance with the teachings of the present disclosure.

With reference to FIG. 1 of the drawings, a tool 10 is illustrated to include a tool body 12 and a hook assembly 14 that is constructed in accordance with the teachings of the present disclosure. In the particular example illustrated, the tool body 12 is a fastening tool, such as a framing nailer, but it will be appreciated that the teachings of the present disclosure have applicability to other types of power tools, including drill/drivers. The tool body 12 can generally include a housing 20 and a motor assembly 22. The housing 20 can include a body portion 30, which can at least partially house the motor assembly 22, and a handle 32 that is configured to permit an operator of the tool 10 to manipulate and guide the tool body 12 in a desired manner. In the particular example provided, the handle 32 includes a handle structure 36, which is fixedly coupled to the body portion 30, and an end cap 38 that is removably coupled to the handle structure 36 with a plurality of threaded fasteners (not shown).

The motor assembly 22 can include an output member 40. In the particular example provided, the motor assembly 22 includes a pneumatic cylinder assembly having a piston 42 to which the output member 40 is coupled. The construction and operation of the motor assembly 22, is discussed in more detail in commonly assigned U.S. Pat. No. 6,648,202 entitled "Pneumatic Fastening Tool" issued on Nov. 18, 2003, the disclosure of which is hereby incorporated by reference as if fully set forth in detail herein. It will be appreciated that other types of tools can employ other types of motor assemblies, including pneumatic or electric motor assemblies having a linear output, a rotary output or a linear and rotary output. Examples of such tools include commonly assigned U.S. Pat. No. 6,431,289 and U.S. patent application Ser. Nos. 11/095,727 and 11/256,595, the disclosures of which are hereby incorporated by reference as if fully set forth in detail herein.

Figure 2:
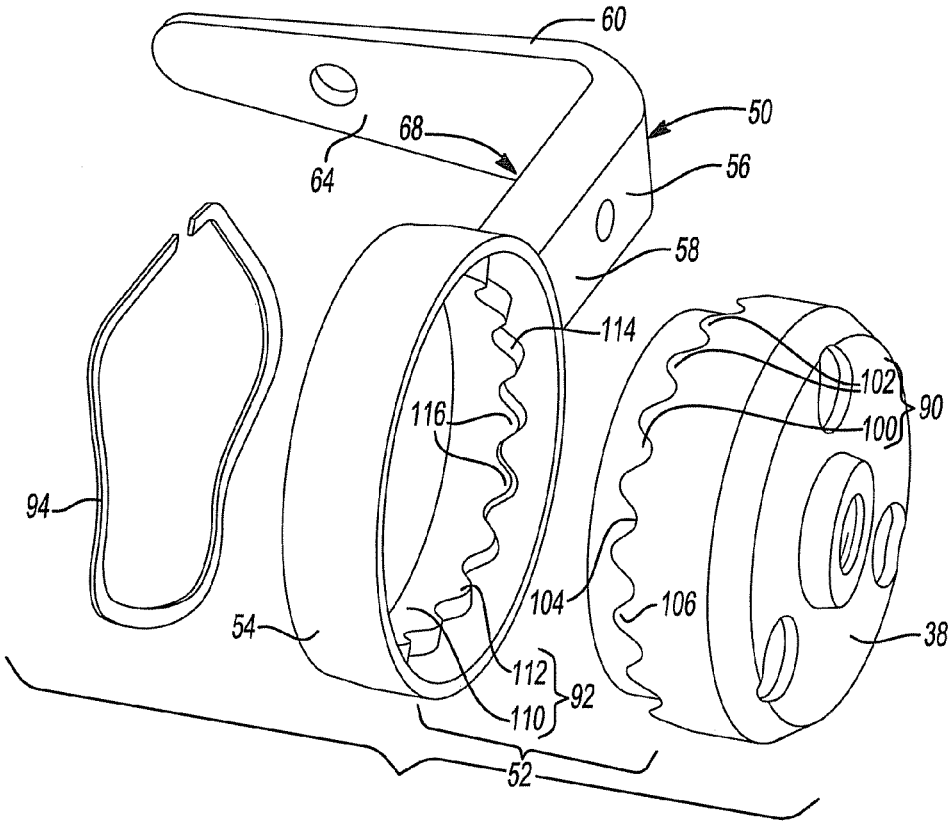
FIG. 2 is an exploded perspective view of a portion of the tool of FIG. 1 illustrating the construction of the hook assembly in more detail.
Figure 4:
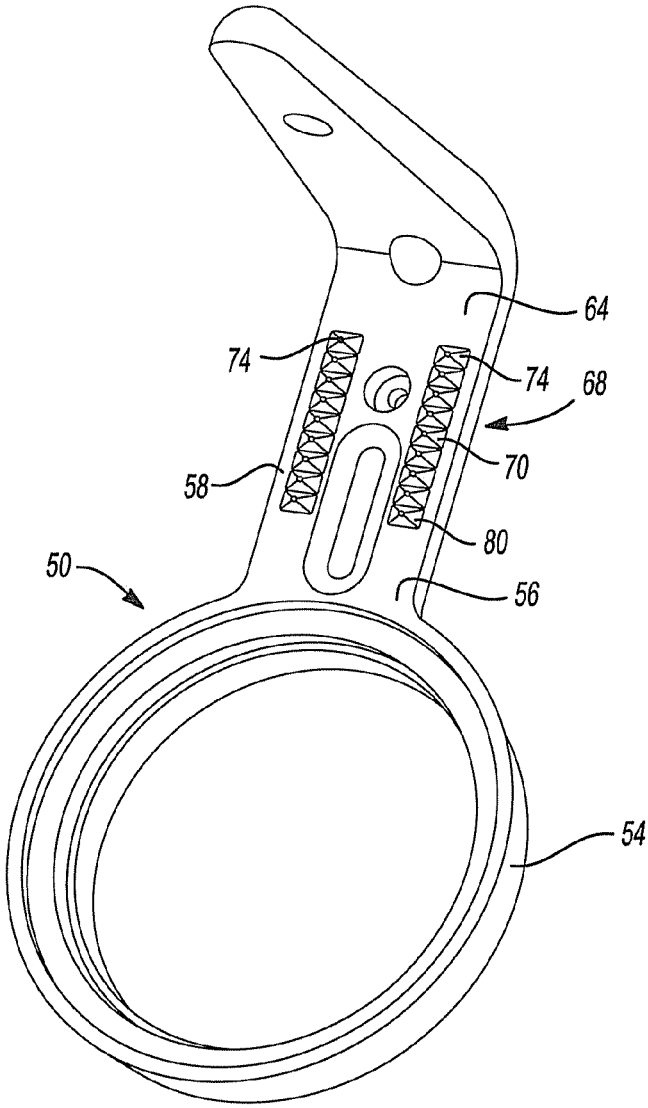
FIG. 4 is a perspective view of the hook structure of the tool of FIG. 1 illustrating the hook structure with an exemplary friction enhancing portion constructed in accordance with the teachings of the present disclosure.
Figure 5:
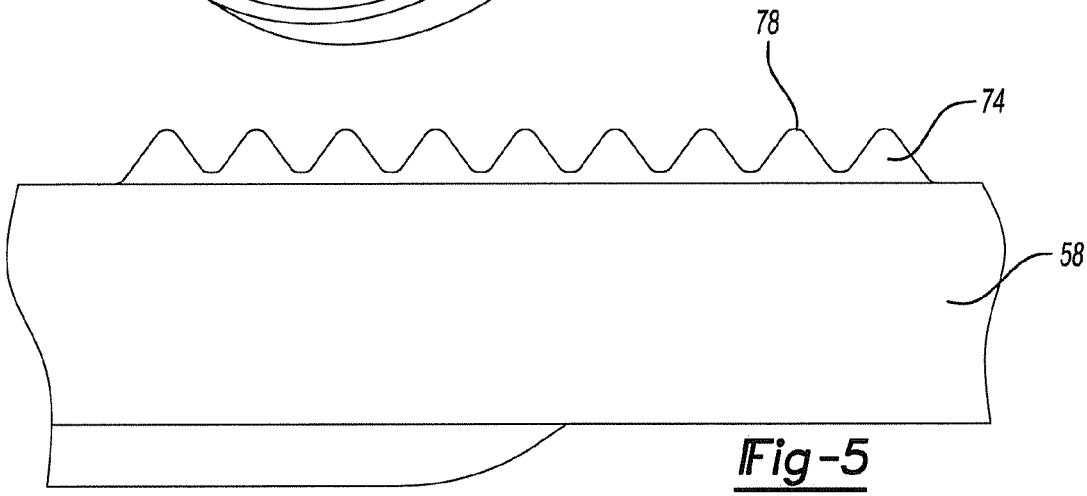
FIG. 5 is a side view of a portion of the hook structure of FIG. 4 illustrating the preferred embodiment of the friction enhancing portion of the hook structure.

With additional reference to FIGS. 2, 4 and 5, the hook assembly 14 can be coupled to a portion of the housing 20, such as the handle 32, and can include a hook structure 50 and a detent 52. The hook structure 50 can include an attachment portion 54, which can be fitted about a portion of the handle 32, such as the end cap 38 of the handle 32, and a hook member 56. The hook member 56 can have an arm 58, which can extend generally perpendicularly from the attachment portion 54, and a leg 60. The leg 60 can be coupled to a distal end of the arm 58 and can extend generally parallel to the handle 32. The hook member 56 can have an interior surface 64 (i.e., the surface of the hook member 56 that is bounded by the leg 60, the arm 58 and the handle 32). While the hook member 56 is illustrated as being an L-shaped member, it will be appreciated by a person of ordinary skill in the art that the hook member 56 may be configured differently. In this regard, the hook member 56 need not be L-shaped, but can be configured in any shape, such as a J-shape, that creates an interior surface that can engage an appropriate structure, such as a belt (not shown) or a rafter (not shown). Moreover, the hook member 56 need not be rigid, but can be composed of any material, such as metal or plastic, that can be employed to suspend the tool 10 from the appropriate structure.

Figure 6:
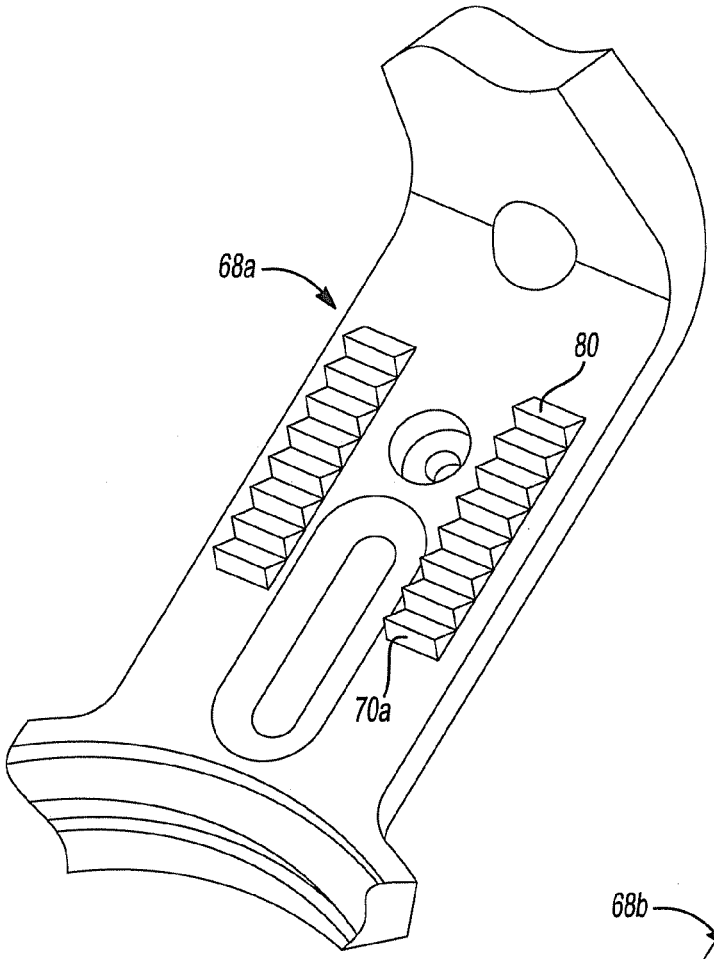
FIGS. 6 and 7 are perspective views similar to that of FIG. 4, but illustrating alternatively constructed friction enhancing portions.
Figure 7:
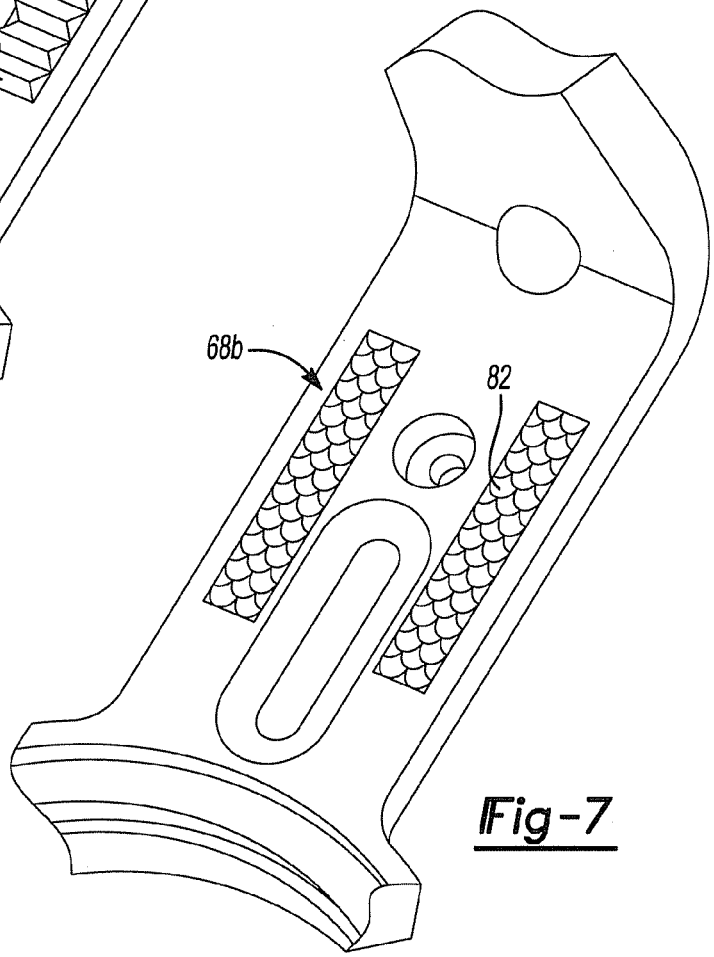

With specific reference to FIGS. 4 and 5, the hook member 56 can include a friction enhancing portion 68 that can be coupled to the interior surface 64. The friction enhancing portion 68 can include knurls 70 that can project outwardly from the interior surface 64. In the particular example provided, the knurls 70 comprise pyramidically shaped structures 74 that can be arranged in a linear pattern, such as rows. The pyramidically shaped structures 74 can terminate at a pointed end portion 78 that can be configured to mechanically and/or frictionally engage the structure from which the tool 10 (FIG. 1) is to be suspended. Those of ordinary skill in the art will appreciate that numerous variables, including the surface area of the portion of the knurls 70 in contact with the structure, will dictate the degree to which the knurls 70 mechanically and/or frictionally engage the structure from which the tool 10 (FIG. 1) is to be suspended. Accordingly, those of ordinary skill in the art will appreciate that friction enhancing portion 68 need not be formed with pyramidically shaped structures 74 or even knurls 70. For example, the friction enhancing portion 68*a* can employ knurls 70*a* that comprise teeth or triangular shaped prisms 80 as shown in FIG. 6. As another example, the friction enhancing portion 68*b* can employ a plurality of edged structures, such as fish-scale shaped structures 82 as shown in FIG. 7.

Figure 3:
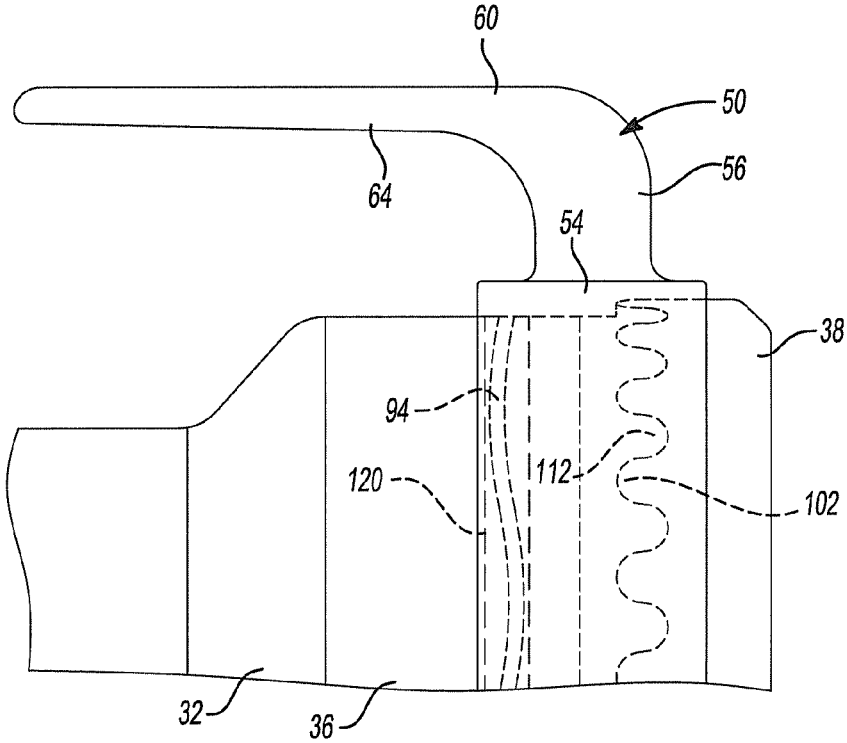
FIG. 3 is a perspective view of a portion of the tool of FIG. 1 illustrating the first and second portions of a detent in an engaged position.

With reference to FIGS. 1 through 3, the detent 52 can include a first detent portion 90, a second detent portion 92 and a spring 94. The first detent portion 90 can be formed on the portion of the housing 20, such as the end cap 38 of the handle 32, and can include a first pilot portion 100, which can be cylindrically shaped, and a plurality of projections 102. The projections 102 can be disposed about the first pilot portion 100 and can define a first axially undulating end surface 104. In the particular example provided, the projections 102 are generally sinusoidal in shape and form a plurality of crests 106, but it will be appreciated that other shapes may be employed in the alternative.

The second detent portion 92 can be coupled to or formed on the attachment portion 54 and can include a second pilot portion 110 and a plurality of mating projections 112. The second pilot portion 110 can be configured to align or aid in radially aligning the mating projections 112 to the projections 102. In the particular example provided, the second pilot portion 110 is configured to receive the first pilot portion 100 in a slip-fit manner such that the first pilot portion 100 is rotatable within the second pilot portion 110. The mating projections 112 can be disposed about the second pilot portion 110 and can define a second axially undulating end surface 114 that can be configured to engage the first axially undulating end surface 104. In the particular example provided, the mating projections 112 are generally sinusoidal in shape and form a plurality of mating crests 116, but it will be appreciated that other shapes may be employed in the alternative.

The spring 94 can be employed to resiliently bias the projections 102 and mating projections 112 into engagement with one another. The spring 94 can be any appropriate type of spring, such as a compression spring or a wave spring. In the example provided, the spring 94 is disposed between an annular ridge 120 that is formed on the handle structure 36 and the attachment portion 54 and biases the hook structure 50 toward the end cap 38 such that the mating projections 112 engage the projections 102 to thereby resist relative rotation between the hook structure 50 and the handle 32. As the spring 94 may be compressed, however, it will be appreciated that the mating projections 112 may be moved axially apart from the projections 102 to permit the hook member 56 to be rotated into a desired rotational position relative to the handle 32. The sinusoidal shape of the projections 102 and the mating projections 112 cooperate in a cam-like manner to permit relative axial movement of the mating projections 112 in response to a user's purposeful rotation of the hook member 56.

Figure 8:
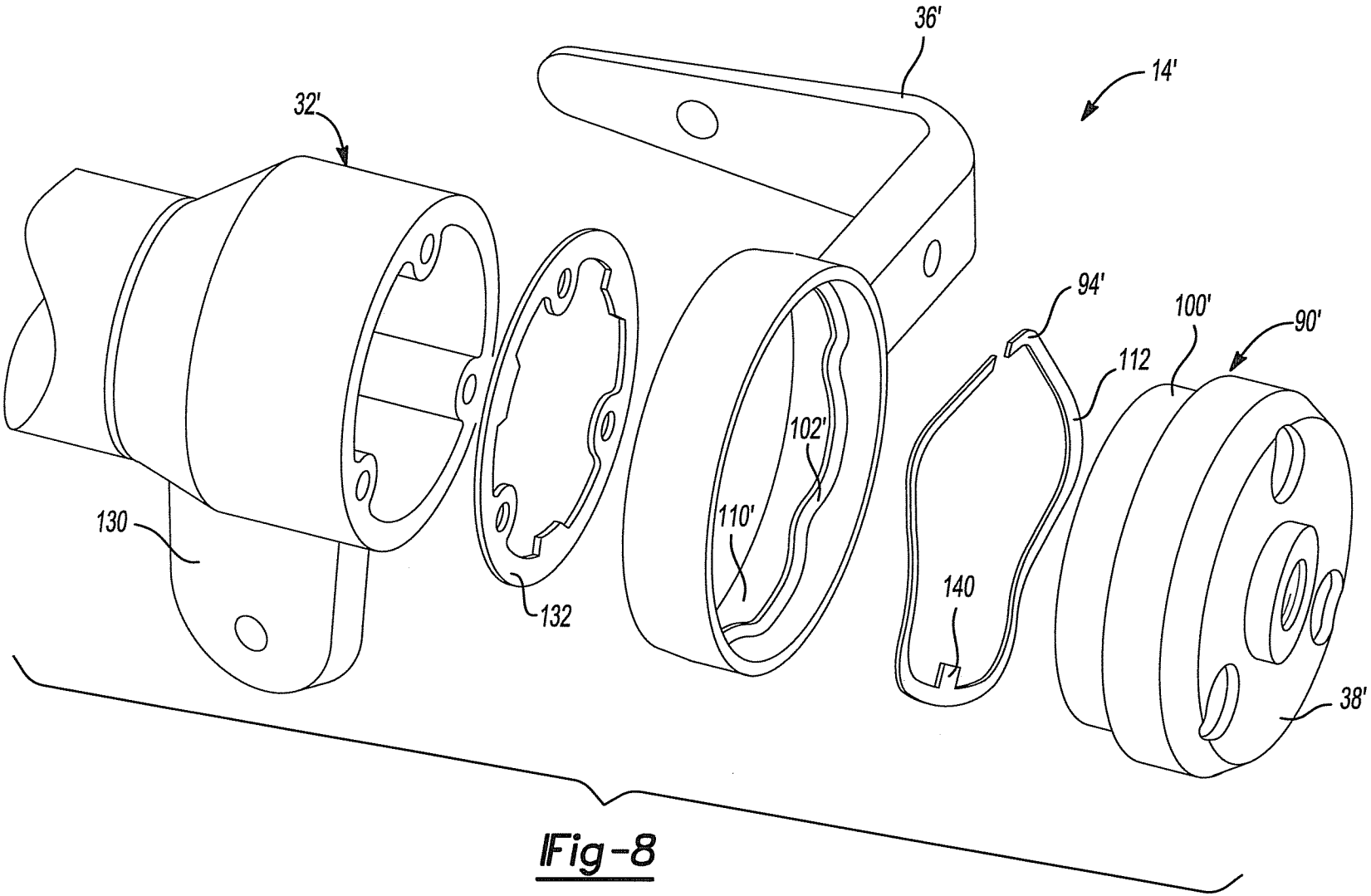
FIG. 8 is an exploded perspective view of a portion of a second tool having another hook assembly constructed in accordance with the teachings of the present disclosure.
Figure 9:
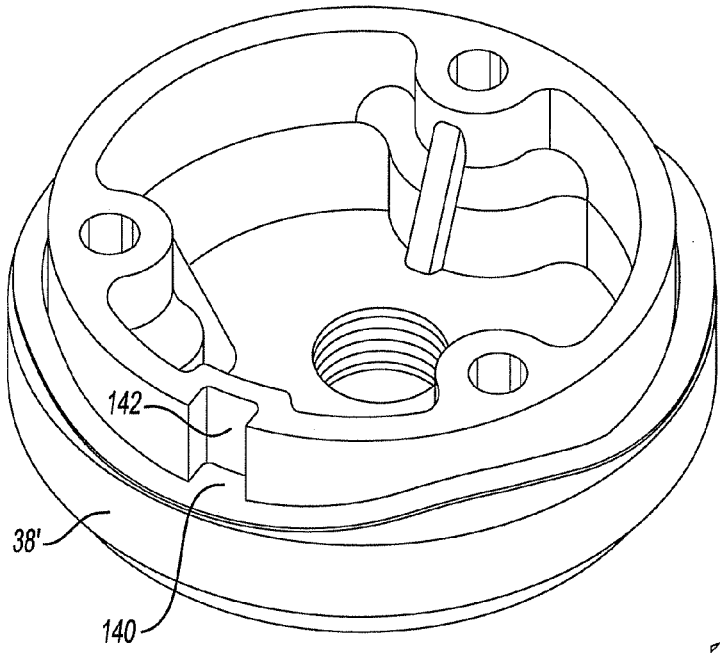
FIG. 9 is a perspective view of a portion of the tool of FIG. 8 illustrating a portion of the detent.
Figure 10:
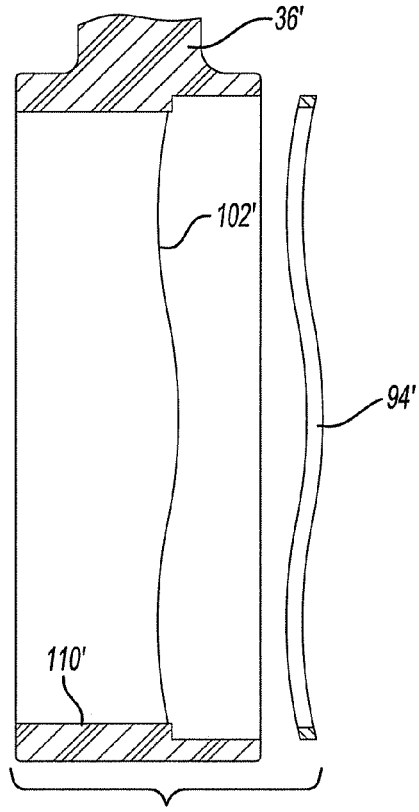
FIG. 10 is a sectional view of a portion of the tool of FIG. 8 taken longitudinally through the handle, the view illustrating a portion of a detent.

It will be appreciated from this disclosure that the detent 52 may be constructed somewhat differently from that which is described above without departing from the scope and spirit of this disclosure. For example, the projections 102 or the mating projections could be formed on different structures from those identified above. For example, the projections 102 could be formed on the handle structure 36 rather than the end cap 38. As another example, the projections 102 could be formed on the spring 94' as illustrated in FIG. 8. In this example, the first detent portion 90' includes a first pilot portion 100' and a plurality of projections 102'. The first pilot portion 100' can be formed in part by the handle structure 36' and in part by the end cap 38'. As with the example described above, the first pilot portion 100' is received in the second pilot portion 110' and is configured to align or aid in radially aligning the mating projections 112 to the projections 102' when the second pilot portion 110' is rotated about the first pilot portion 100'. In the example provided, the second pilot portion 110' is axially captured on the handle 32' by the end cap 38' and a magazine mounting lug 130 that is carried by the handle structure 36'. Alternatively, the handle structure 36' could be configured with an annular rib (not shown) that limits axial movement of the hook structure 50' toward the handle structure 36'. While not germane to the hook assembly 14', a gasket 132 can be employed between the handle structure 36' and the end cap 38' to seal the interface therebetween.

The projections 102' can be coupled to the spring 94' and in the particular example provided, are integrally formed with the spring 94'. The spring 94' can be fitted about the portion of the first pilot portion 100' that is associated with the end cap 38'. The spring 94' can be non-rotatably coupled to the handle 32' and can include a locking tab 140. The locking tab 140 can be received in a locking tab recess 142 that can be formed in a portion of the handle 32', such as the end cap 38'. In the example provided, the locking tab recess 142 is an axially extending groove formed into the portion of the first pilot portion 100' that is formed on the end cap 38'. It will be appreciated that the locking tab 140 may be formed on the handle 32' and the locking tab recess 142 may be formed in the spring 94' in the alternative. As the end cap 38' is fixed to the handle structure 36', the spring 94' biases the hook structure 50 into abutment with the magazine mounting lug 130. Engagement of the projections 102' and the mating projections 112 resists relative rotation of the hook structure 50. It will be appreciated that purposeful rotation of the hook structure 50 by the user will cause the spring 94' to compress and permit the mating projections 112 to ride over the projections 102'.

While the spring has been illustrated and described as being non-rotatably coupled to the housing and forming the projections, it will be appreciated that in the alternative, the spring may be non-rotatably coupled to the hook structure to form the mating projections.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

What is claimed is:

1. A tool comprising:

a housing with a handle;

a motor assembly with an output member, the motor assembly being at least partially housed in the housing;

a hook structure having an annular body and an L-shaped member, the annular body being rotatably received around the handle, the L-shaped member having an arm, which is connected to the annular body and extends radially outwardly therefrom, and a leg that is connected to an end of the arm opposite the annular body; and a spring mounted coaxially on the handle and engaging the annular body to resist relative rotation of the hook structure relative to the handle.

2. The tool of claim 1, a plurality of protrusions that are coupled to the handle and wherein the annular body includes a plurality of mating protrusions that engage the plurality of protrusions.

3. The tool of claim 2, wherein the plurality of protrusions are integrally formed with a portion of the handle.

4. The tool of claim 1, wherein the spring is a wave spring.

5. The tool of claim 4, wherein one of the wave spring and the housing includes a locking tab and the other of the wave spring and the housing includes a locking tab receptor that receives the locking tab to non-rotatably couple the wave spring and the housing.

6. The tool of claim 1, wherein the hook structure has an interior surface that is bounded by the leg, the arm and the housing, the hook structure including a friction enhancing portion that is coupled to the interior surface.

7. The tool of claim 6, wherein the friction enhancing portion comprises knurls.

8. The tool of claim 7, wherein the knurls include pyramidically shaped structures.

9. The tool of claim 7, wherein the knurls are integrally formed with a portion of the hook structure.

10. The tool of claim 6, wherein the friction enhancing portion comprises a plurality of teeth.

11. The tool of claim 10, wherein the plurality of teeth is integrally formed with a portion of the hook structure.

12. A tool comprising:

a housing with a handle with a plurality of protrusions integrally formed with a portion of the handle;

a motor assembly with an output member, the motor assembly being at least partially housed in the housing;

a hook structure having an annular body and an L-shaped member, the annular body being rotatably received around the handle and including a plurality of mating protrusions that matingly engage the plurality of protrusions of the handle, the L-shaped member having an arm, which is connected to the annular body and extends radially outwardly therefrom, and a leg that is connected to an end of the arm opposite the annular body; and a wave spring mounted coaxially on the handle and engaging the annular body to resist relative rotation of the hook structure relative to the handle;

wherein the hook structure has an interior surface that is bounded by the leg, the arm and the housing, the hook structure including a friction enhancing portion that is coupled to the interior surface.

* * * * *